United States Patent [19]

Musil

[11] Patent Number: 4,813,784

[45] Date of Patent: Mar. 21, 1989

[54] REVERSE FLOW POST-MIXER ATTACHMENT AND METHOD FOR DIRECT-FIRED ASPHALTIC CONCRETE DRUM MIXERS

[76] Inventor: Joseph E. Musil, c/o Cedarapids, Inc., 916 Sixteenth St. NE., Cedar Rapids, Iowa 52402

[21] Appl. No.: 89,179

[22] Filed: Aug. 25, 1987

[51] Int. Cl.[4] ..... B28C 5/20; B28C 5/46; B28C 7/12; B28C 7/16

[52] U.S. Cl. ..... 366/24; 366/25; 366/34; 366/42; 366/57; 366/59; 366/228; 34/136; 422/111; 422/117; 422/118

[58] Field of Search ..... 366/22, 23, 24, 25, 366/34, 42, 54, 57, 58, 59, 144, 220, 228; 34/128, 136; 432/108, 111, 117, 118

[56] References Cited

U.S. PATENT DOCUMENTS

| | | | |
|---|---|---|---|
| 1,336,422 | 4/1920 | Burman | 34/136 |
| 2,487,887 | 11/1949 | McEachran . | |
| 4,136,966 | 1/1979 | Menhenhall | 366/25 |
| 4,165,184 | 8/1979 | Schlarmann | 366/57 |
| 4,207,062 | 6/1980 | Moench et al. | 432/111 |

FOREIGN PATENT DOCUMENTS

| | | | |
|---|---|---|---|
| 882078 | 5/1943 | France | 34/136 |
| 197809 | 9/1978 | France | 34/136 |

*Primary Examiner*—Harvey C. Hornsby
*Assistant Examiner*—Joseph S. Machuga
*Attorney, Agent, or Firm*—Simmons, Perrine, Albright & Ellwood

[57] ABSTRACT

A reverse flow post-mixer attachment for direct-fixed asphaltic concrete mixers includes a modified discharge box for the downstream end of the drum and an enclosure for the downstream portion of the drum forming a passage along the exterior of the drum. If the smoke point of the liquid asphalt to be added to the material in the drum meets an established standard it is injected into the material upstream of the downstream end of the drum and discharged from the latter end in the normal manner. If the smoke point of the asphalt does not meet the standard, the material exiting the drum is diverted into the passage along the exterior of the drum and the asphalt added there out of the burner stream in the drum. The material and asphalt are then mixed and moved through the passage and finally discharged.

15 Claims, 4 Drawing Sheets

REVERSE FLOW POST-MIXER ATTACHMENT AND METHOD FOR DIRECT-FIRED ASPHALTIC CONCRETE DRUM MIXERS

BACKGROUND OF THE INVENTION

Drum type mixers for the production of asphaltic concrete or the recycling of used asphaltic pavement are afflicted with two ills, the production of blue smoke and the emission of particulates. The first arises because asphaltic drum mixers are typically of the "direct-fired" kind, meaning that there is direct contact of the hot burner gases with the asphalt. The second results because dust and fines from the aggregate or recycle material are entrained in the stream of hot air and gases through the drum. Current Federal standards limit smoke, referred to as the "opacity", to 20 percent vision impairment and the emission of particulates to no more than 0.04 grains per dry standard cubic foot ("GR/DSCF"). The latter standard is easily achieved with current bag houses but the former standard is another matter entirely.

Opacity arises, it has been found, not from the asphalt in old pavement being recycled—its asphalt is too old, too brittle, and too oxidized to contribute much to the smoke problem. Rather opacity stems chiefly from the lighter fresh asphalt, whether that added to all virgin aggregate or that added to recycled pavement. Mysteriously, asphalts of the same penetration and the same viscosity—the two indices by which all asphalts are graded—can have totally different smoke points. An asphalt obtained from one source may have a lower or higher smoke point than an asphalt of identical grade obtained from another source. One simply cannot tell whether an asphalt will or will not abide by the standard until it is actually injected into the heat of the drum. Consequently, to thwart the opacity problem the asphalt injection point has been moved further and further downstream in the drum. But that in turn often unduly shortens the span over which the fresh asphalt is mixed with the aggregate or recycled pavement - unless the drum is lengthened to compensate. Lengthening the drum, however, adds to cost and, more critically, encumbers the portability of the drum mixer. This is important because the majority of drum mixers are portable. Another tack, also encumbering and costly, has been to empty the drum mixer into, in effect, a wholly separate drum or a pugmill and add the fresh asphalt there, out of the burner's stream.

So the primary objects of the present invention are to accommodate liquid asphalts of low smoke points without lengthening the drum and without the need for an additional drum, pugmill or the like, all in order to preserve portability of the plant and to minimize cost. Another object of the invention is to do so with components which can be supplied either as an option to a drum mixer on order or as a "retro-fit" kit or attachment for one already in the field. A further object of the invention is also to do so in a manner which allows the drum mixer to be operated in normal fashion when the smoke point of the asphalt used is high enough to meet the opacity standard.

SUMMARY OF THE INVENTION

The objects of the invention are achieved by increasing the effective length of the drum without at the same time increasing its overall length. This seeming paradox is accomplished by an attachment which includes a stationary housing for spacedly encompassing the downstream portion of the drum with respect to the direction of material flow through the drum, the burner being at the upstream end of the drum. The upstream portion of the housing includes a lower semi-circular wall concentric with the drum and forming a semi-annular passage between that wall and the drum. One end of the housing lower wall extends a short distance beyond the downstream end of the drum in order to receive material exiting the drum. The rear or downstream portion of the housing constitutes an alternate discharge box replacing the normal one for the particulate laden air and hot gases from the drum, which box in turn is connectable to a typical bag house. The normal discharge blades at the downstream end of the drum itself are replaced with skewed blades which move the material exiting the drum first onto the adjacent end of the lower housing wall then into the semi-annular passage between the drum and the lower housing wall, thus reversing the direction of flow of the material. The exterior of the drum encompassed by the housing is fitted with paddles or the like which mix the material and move it in the reverse direction through the semi-annular passage to an alternate discharge port adjacent the other end of the lower housing wall.

The fresh asphalt is introduced through an alternate pipe onto the material adjacent the upstream end of the semi-annular passage so that the asphalt is thoroughly mixed with the material by the paddles or the like as it passes between the drum and the lower housing wall. The latter wall is heated by hot oil passing through ducts secured to its exterior in order to bring the wall up to proper temperature when the plant is started and to maintain the mix at the proper temperature thereafter. Hence, the effective length of the drum is increased by the length of the semi-annular passage and since the asphalt is injected adjacent the upstream end of that passage, it is substantially out of the burner stream and thus kept below its smoke point. The overall length of the drum mixer is not increased because the discharge box portion of the housing is merely greater in its transverse dimensions than the normal one. Hence the apparatus of the invention is aptly designated a "reverse flow post-mixer".

Inasmuch as, depending on the smoke point of a particular asphalt, the post-mixer need not always be used, preferably the drum mixer should be capable of normal operation when the smoke point of the asphalt meets or exceeds the opacity standard, but readily switched to the post-mixer when the smoke point of the asphalt does not. To that end the lower housing wall just below the downstream end of the drum is provided with a normal discharge port which can be opened or closed by a door. The normal asphalt injection pipe is retained, the alternate pipe being branched off the former and a valve provided at the branch so that flow can be switched from one pipe to the other. When operating conventionally, the normal discharge port is open, the normal discharge blades are used, and asphalt flow is directed through the normal pipe. The drum mixer then functions in customary manner. Simply closing the normal discharge port, replacing the normal discharge blades with the skewed blades, and switching asphalt flow to the alternate pipe invokes the post-mixer when needed. Thus the method aspect of the invention involves operating the drum mixer either normally when the smoke point of the asphalt meets the standard, or alternately, when it does not, so that the flow of material after it has departed the drum is reversed and flowed along an exterior portion of the drum where it is mixed with the asphalt.

All the components of the post-mixer attachment can be either fitted, as an option, to a drum mixer at the time it is manufactured, or can be supplied as a "kit", as it were, for ready fitting to a drum mixer already in the field after removal of its discharge box. Other features and advantages of the present invention will be apparent from the drawings and from the more detailed description which follows.

DETAILED DESCRIPTION OF THE PREFERRED EMBODIMENT

Figure 1:
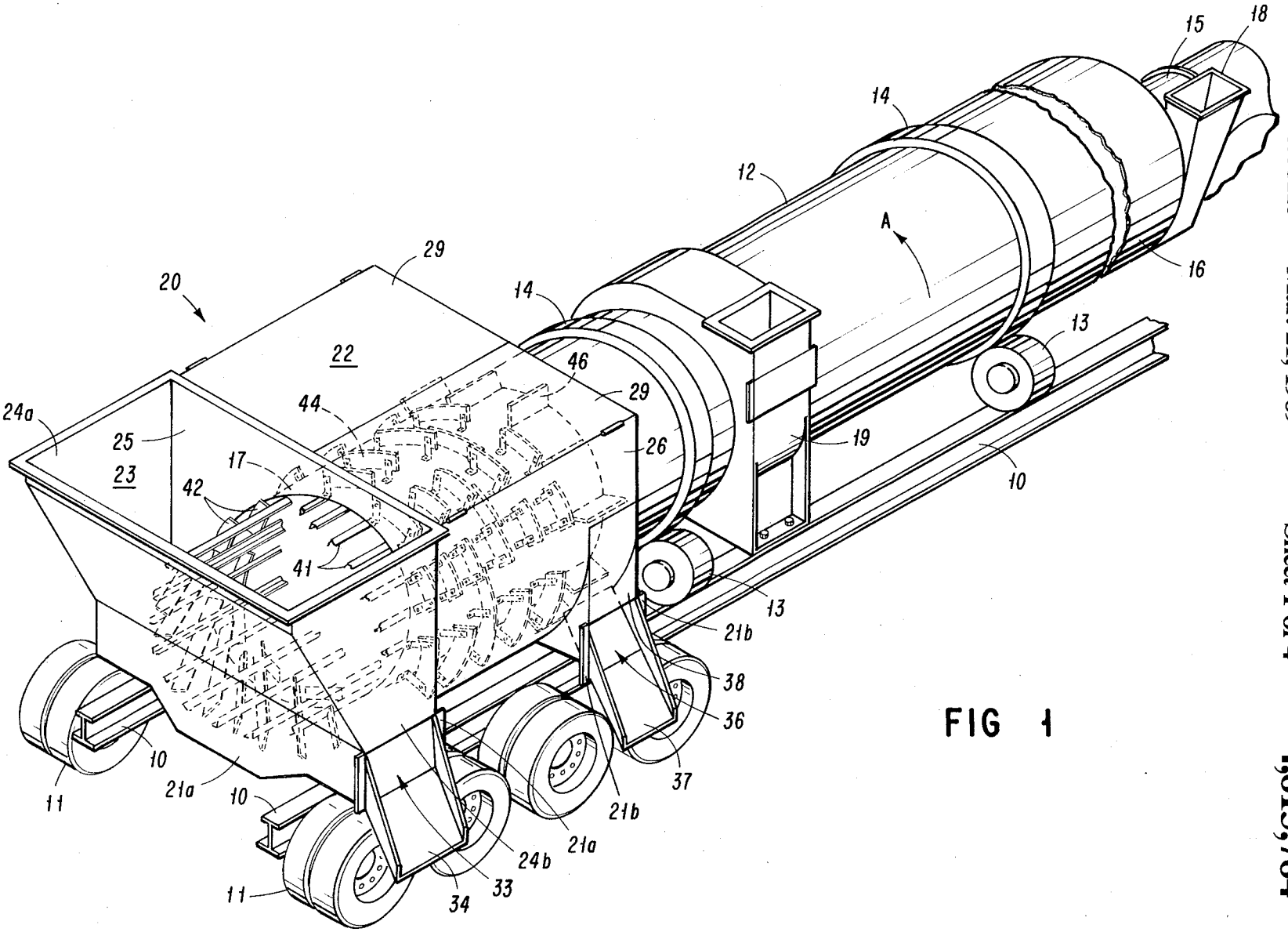
FIG. 1 is a perspective view of a portion of a typical direct-fired drum mixer shown with the post-mixer attachment of the invention applied to it.

The direct-fired drum mixer shown in FIG. 1 is typical of those currently in use. A frame 10, which is provided with wheels 11 in order for the mixer to be portable, supports a cylindrical drum 12 on two spaced pairs of rollers 13 (only one of each pair being shown in FIG. 1) disposed intermediate the ends of the drum 12, the rollers 13 revolving against a pair of steel "tires" 14. The drum 12 is rotated about its axis in the direction shown by the arrow "A" by a "positive cradle chain drive" (not shown) of a type well-known in the art. A burner 15 at the upstream end 16 of the drum 12 discharges air and hot gases through the interior of the drum 12 and out its downstream end 17 into a discharge box which in turn leads to a bag house (not shown) for filtering particulate matter exhausted from the drum 12. A chute 18 introduces material into the drum 12 at its upstream end 16 Which then moves through the drum 12 to its downstream end 17. The mixer may also have provision for recycling used asphalt pavement, such as that shown in U.S. Pat. No. 4,395,129 to Musil, and generally indicated at 19 in FIG. 1.

Figure 2:
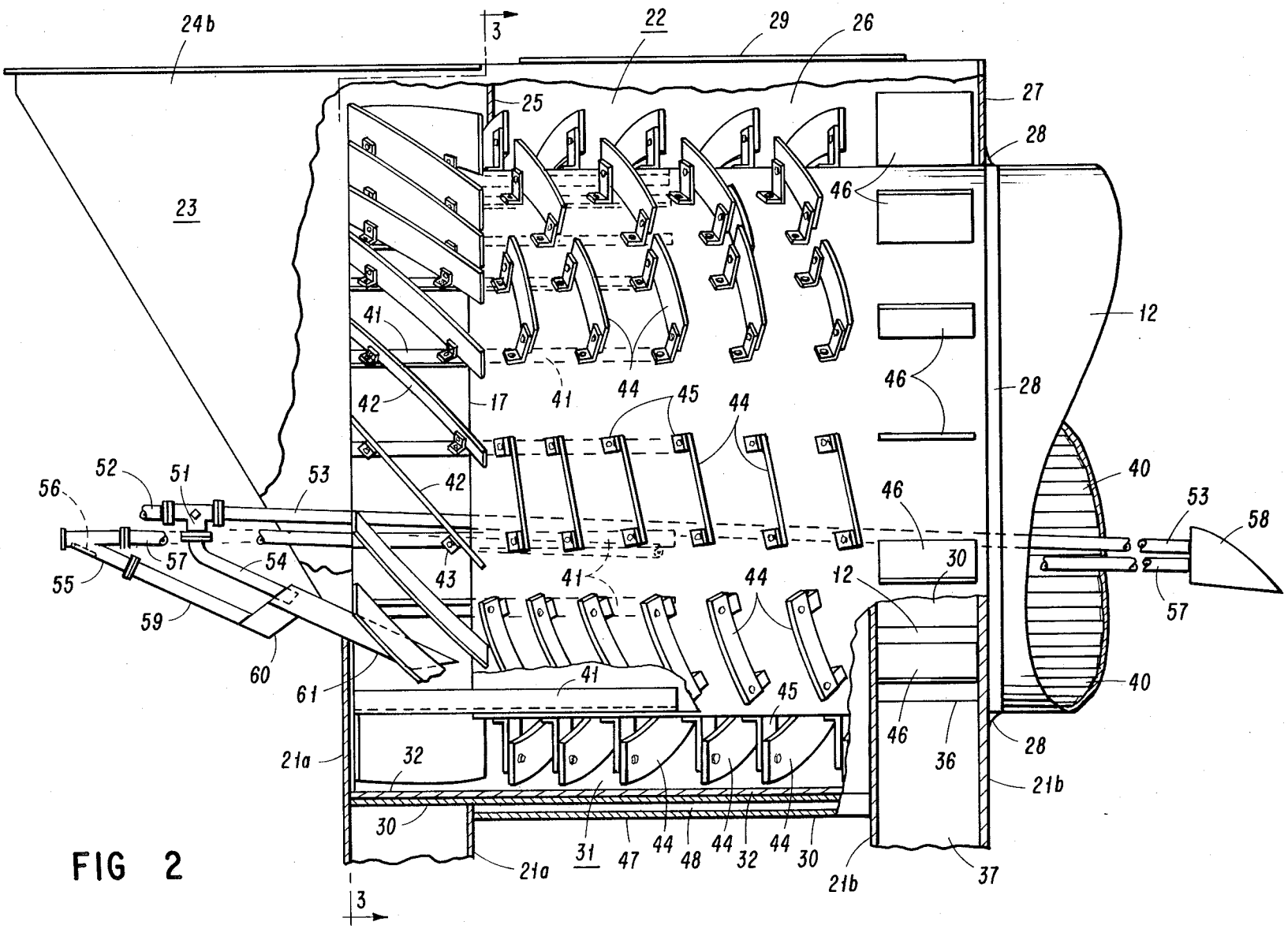
FIG. 2 is a side elevational view of a portion of FIG. 1, certain parts being broken away and sectioned to illustrate various details of the invention.
Figure 3:
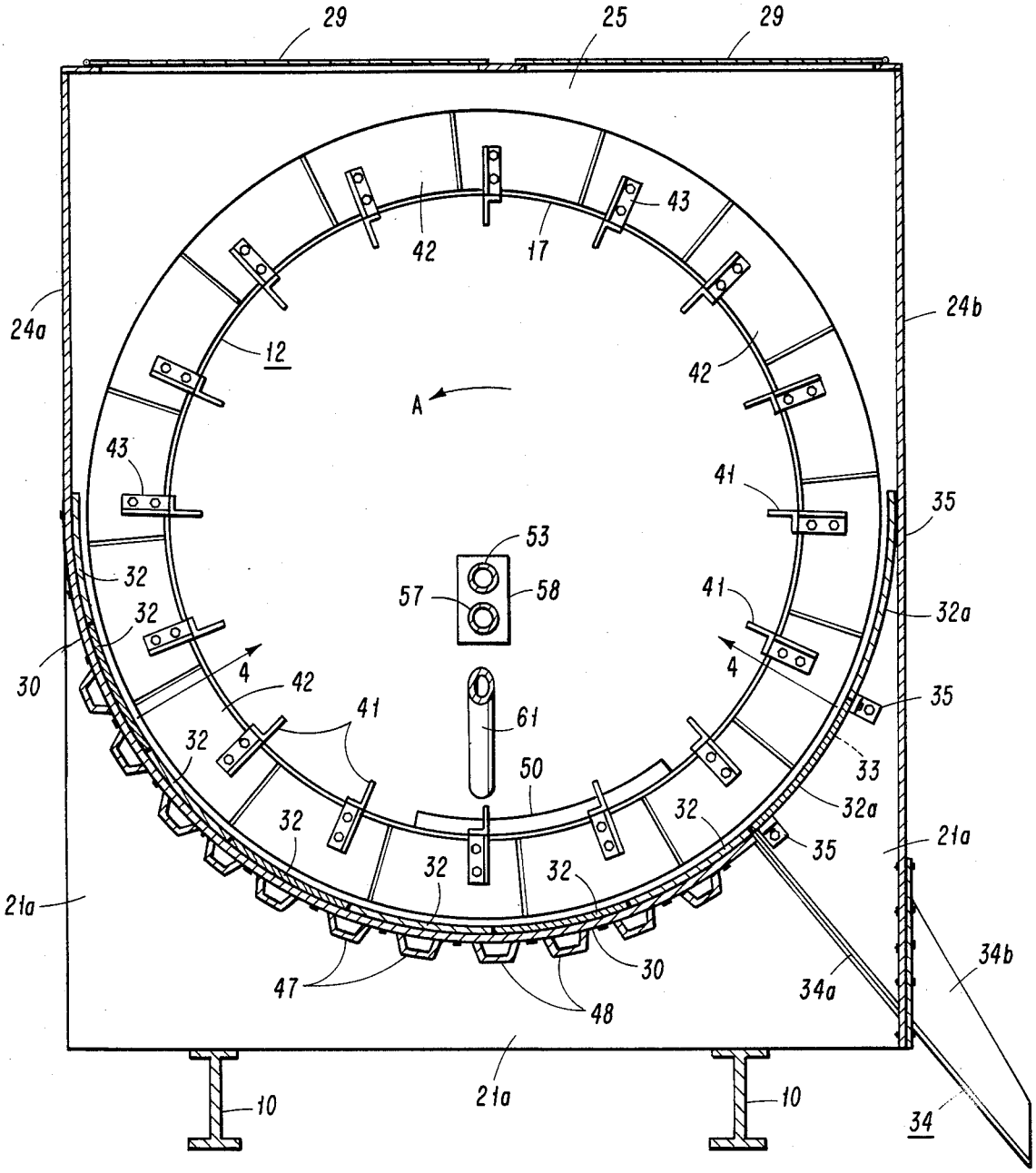
FIG. 3 is a sectional view taken along the line 3—3 of FIG. 2.

When the drum mixer is equipped with the post-mixer attachment of the invention the normal discharge box is replaced with a stationary enclosure or housing, generally indicated at 20, supported on the frame 10 by two pairs of transverse plates **21*a* and 21*b* (see FIGS. 1–3). The housing 20 consists essentially of two parts, a semi-sleeve 22 spacedly enveloping the downstream portion of the drum 12 beyond the rear rollers 13 and "tire" 14 and joined to an alternate discharge box 23, the rearmost transverse plate 21*a* forming the lower rear end wall of the box 23. The box 23 further includes side walls 24*a* and 24*b* a front end wall 25 at the downstream end 17 of the drum 12 which opens through the box end wall 25, the top of the box 23 being open for discharge of air and hot gases to the bag house. The upper half of the sleeve 22 includes a pair of flat side walls 26, a front end wall 27 apertured to receive the drum 12 and provided with a circular lip seal 28 against the rotating exterior of the drum 12, and a flat top wall in the form of a pair of hinged doors 29 for access to the interior of the sleeve 22. The box sidewall 24*a* and the sleeve side walls 26 extend down level with the axis of the drum 12 and their lower halves form an arcuate bottom wall 30 concentric with and spaced from the exterior of the drum 12, the wall 30 extending back to the rear-most transverse plate 21*a* and also constituting the bottom wall of the discharge box 23. Consequently, the lower half of the drum 12 and the bottom wall 30 together define a semi-annular tunnel or passage 31 extending from the downstream end 17 of the drum 12 to the forward-most transverse plate 21*b* which also forms the front end wall of the lower half of the sleeve 22**.

The inner surface of the bottom wall 30 is covered by segmental wear plates 32 and the wall 30 downstream of the passage 31 is provided with a normal material discharge port 33 somewhat past the bottom dead center of the drum 12 with respect to its direction of rotation "A" (see FIGS. 1 and 3). An inclined discharge chute 34 for the port 33 is formed by a floor plate **34*a* between the adjacent pair of transverse support plates 21*a*, the floor plate 34*a* emerging below the adjacent discharge box side wall 24*b* (see FIG. 1), and formed therebeyond with upright side walls 34*b* which are secured in turn to flanges on the adjacent ends of the two transverse plates 21*a* in order to support the chute 34. The discharge port 3 is opened and closed by a portion 32*a* of one of the wear plates 32, which portion 32*a* may be removably bolted at 35 to the two transverse support plates 21*a* (see FIG. 3) or simply slid up and down to open and close the port 33. An alternate discharge port 36 (see FIGS. 1 and 2) is provided through the other end of the wall 30 and wear plates 32 between the two transverse plates 21*b* and positioned like the port 33 with respect to the bottom dead center of the drum 12. A similar discharge chute 37 is fitted to the port 36 between the adjacent two transverse plates 22*b* and below a plate 38 depending from the sleeve side wall 26 between the two plates 22*b* (see FIG. 1**).

Figure 4:
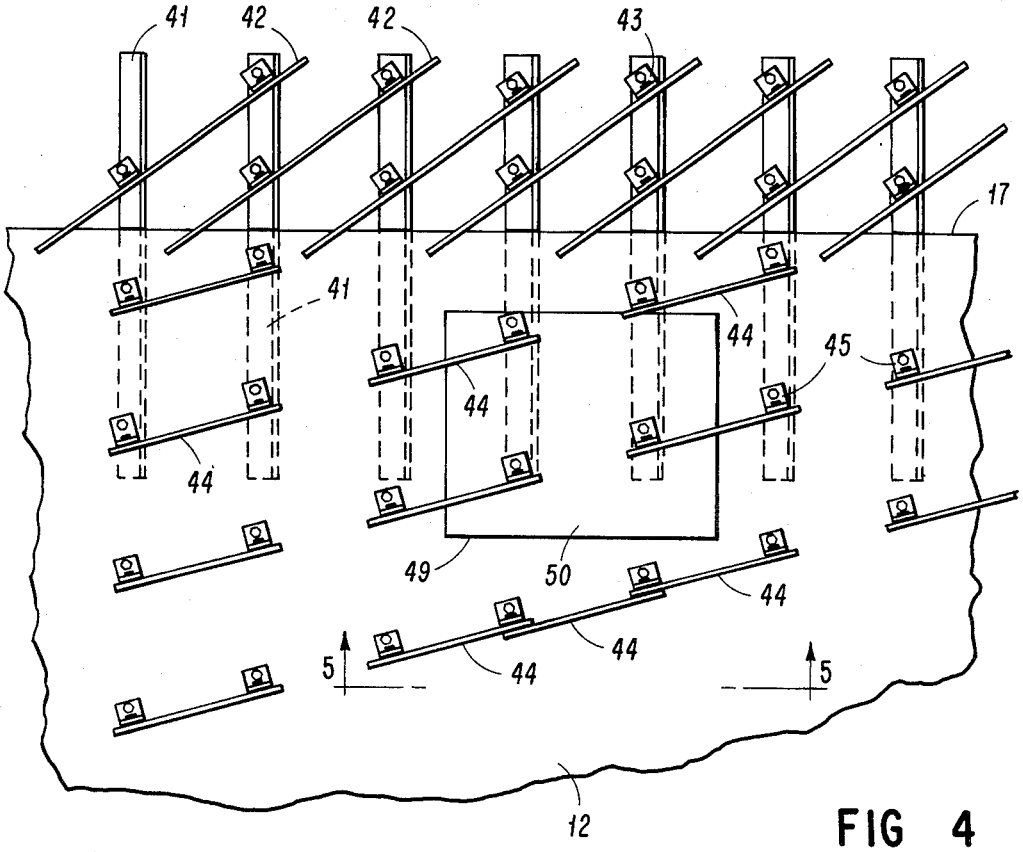
FIG. 4 is a detail view taken along the line 4—4 of FIG. 3.
Figure 5:
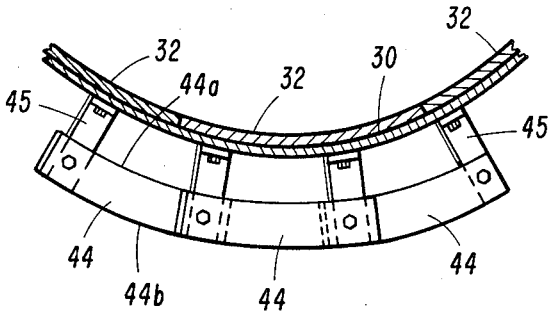
FIG. 5 is a sectional view taken along the line 5—5 of FIG. 4.

The downstream-most end of a drum mixer is typically fitted with a circle of rearwardly extending angle members 41 parallel to the axis of the drum and downstream of the regular flighting 40 indicated in FIG. 2. Those angle members 41 typically support a circle of normal discharge blades parallel to the axis of the drum. These blades are replaced with a circle of alternate discharge blades 42 on brackets 43, the blades 42 being skewed with respect to the direction "A" of drum rotation effective to push material exiting the drum 12 onto what then becomes the upstream end of the passage 31. Obviously other suitable means could be employed to mount the blades 42. The exterior of the drum 12 within the sleeve 22 is fitted in turn with a large number of "paddles" 44 mounted on brackets 45 which may be secured to the drum 12 using the bolt holes of the flighting 40 and angle members 41. The paddles 44 which are of equal lengths are arranged to form in effect several helical flights around the exterior of the surface of the drum 12 in order to move the material through the passage 31. The ends of the paddles 44 of each flight may be spaced apart end-to-end, as shown in FIGS. 2 and 4, to form short lengths, or some or all can be joined at their ends to form longer lengths, of each flight, as shown in FIGS. 4 and 5. Note from FIG. 5 that the height of the paddles 44 is less than the radial thickness of the passage 31 so as to leave spaces between the drum 12 and the inner longitudinal edges **44*a* of the paddles 44** in order to mix as well as to move material in the passage 31, the opposite outer longitudinal edges 44*b* of the paddles 44 in turn closely abutting the wall 30. By using paddles 44 of different heights, or by joining the paddles 44 end-to-end in some of the flights, or even by altering the angle of pitch of the paddles 44, or by doing all or some of these, various combinations of rate of movement versus degree of mixing of the material can be achieved. Spacing the paddles 44 of one or more flights apart, or decreasing the height of the paddles 44, or decreasing the pitch of the paddles 44, or again doing all or some of these, will slow movement of the material but increase its mixing, and vice versa. At what then becomes the downstream end of the passage 31, the exterior of the drum 12 is fitted with a circle of radially extending discharge blades 46 parallel to the axis of the drum 12 which urge the material into the alternate discharge port 36 and down the chute 37.

The exterior of the bottom wall 30 is provided with a number of hat-section channels 47 (see FIGS. 2 and 3) secured thereto to form ducts 48 for the circulation of hot oil in order to bring the wall 30 up to proper temperature when the plant is started-up and to help maintain the temperature of the material as it proceeds through the passage 31. An opening 49 (see FIG. 4) closely adjacent the downstream end 17 of the drum 12 and closed by a door 50 (see FIG. 3) is preferably included through which to inspect and if necessary replace the wear plates 32. A valve 51 is inserted in the normal liquid asphalt supply pipe 52 for directing the asphalt either normally into the drum 12 well upstream of its downstream end 17 through a pipe 53 or through an alternate pipe 54. Fabric filter dust from the bag house arrives at a branch fitting 55 containing a flap valve 56 to direct the dust either normally through a pipe 57 where it joins the asphalt in a mixer 58 at the downstream ends of the pipes 53 and 57, or alternately through a pipe 59 leading to a fitting 60 over the end of the asphalt pipe 54 which injects the dust tangentially into the asphalt. The asphalt and dust then pass through a larger pipe 61 extending down as close as possible to the upstream end of the passage 31 without striking the angle members 41 during rotation of the drum 12.

As mentioned before, the post-mixer attachment of the invention can be fitted as an option to a drum mixer during its initial manufacture, or supplied as a kit for fitting to a drum mixer in the field. Since all commercially available drum mixers support the drum intermediate its ends, as on rollers 13 and "tires" 14, and since the downstream roller and "tire" are typically distant from the downstream end of the drum about onequarter of the length of the drum, the downstream-most portion of the drum is in effect cantilevered with respect to the frame below. Hence, when supplied as a retro-fit in the field, the normal discharge box can be simply removed, after removal of the normal discharge blades at the downstream end of the drum, and the housing 20, complete with the wear plates 32 and chutes 34 and 37, placed on the frame 10 and slipped over the adjacent cantilevered portion of the drum 12. The skewed discharge blades 42 can then be installed through the open top of the discharge box 23, and the paddles 44 and blades 46 secured on the drum 12 after opening the doors 29, by rotating the drum 12 step-by-step. With the wear plate or door 32*a* removed, the normal discharge blades re-installed, and the asphalt and dust directed through the pipes 53 and 57, the drum mixer functions normally when the smoke point of the liquid asphalt is high enough to keep smoke within the opacity limit, the material being discharged by the normal discharge blades through the port 33 and down the chute 34 at the downstream end of the drum 12. If the smoke point of the asphalt is too low, the door 32*a* is bolted in place, the skewed discharge blades 42 are installed, hot oil is supplied to the ducts 48, and the asphalt and dust switched to the pipes 54 and 59. The asphalt and dust are thus directed into the material as the blades 42, owing to the closure of the discharge port 33, move the material into the upstream end of the passage 31. In the latter, the asphalt and dust are thoroughly mixed with the material by the paddles 44 as they at the same time move the material through the passage 31 to its downstream end where the discharge blades 46 direct it through the discharge port 36 and down the chute 37. Other aspects of the structure and operation of the invention will be apparent to those of skill in the art.

Though the invention has been described in terms of a particular embodiment, being the best mode known of carrying out the invention, it is not limited to that embodiment alone. Instead, the following claims are to be read as encompassing all adaptations and modifications of the invention falling within its spirit and scope.

I claim:

1. A post-mixer attachment for a direct-fired asphaltic concrete mixer having a generally cylindrical drum with upstream and downstream ends relative to the direction of flow of material through the drum, the drum mixer further including an underlying frame and means disposed at least one pair of spaced locations intermediate said ends for supporting the drum on the frame for rotation about its axis, the attachment comprising: a stationary housing for spacedly enveloping a portion of the drum downsteam of the drum supporting means, the housing including an arcuate wall concentric with the drum and forming a passage between said wall and the lower exterior of the drum for flow of material therethrough, said passage having upstream and downstream ends relative to the direction of flow of material therethrough, one end of said wall being disposed downstream of the downstream end of the drum; means for heating said wall; the housing further including a discharge box at said one end of the wall and communicating with the interior of the drum, the box having an opening for discharge of air and burner gases therefrom; means for supporting the housing on the frame; means for sealing the other end of said wall relative to the exterior wall of the drum; material moving means for the downstream end of the drum effective to move material exiting the downstream end of the drum into said passage; material mixing and moving means for the exterior of the drum for mixing material in and moving the same through said passage to a first material discharge port disposed adjacent said other end of the wall; first means for supply of liquid asphalt to material having exited the downstream end of the drum; a second material discharge port adjacent said one end of the wall for material having exited the downstream end of the drum; means for closing the second material discharge port; and second means for alternately supplying liquid asphalt to material in the drum upstream of the downstream end of the drum, the first asphalt supply means being inoperative when the second material discharge port is open and the second asphalt supply means being inoperative when the second material discharge port is closed.

2. The attachment of claim 1 wherein the housing includes closable means for access to the exterior of said portion of the drum when enveloped as aforesaid by the housing.

3. The attachment of claim 1 wherein said moving means for the downstream end of the drum comprise a plurality of blades for disposition in skewed relation to the axis of the drum effective with respect to the direction of drum rotation to move material into said passage as aforesaid.

4. The attachment of claim 1 wherein said mixing and moving means for the exterior of the drum comprise a plurality of paddles for arrangement to define portions of at least one helix about said exterior wall of the drum effective with respect to the direction of drum rotation to mix and move material through said passage as aforesaid.

5. The attachment of claim 4 wherein said paddles have outer longitudinal edges for disposition closely adjacent the interior surface of said wall and opposite inner longitudinal edges for spaced disposition from the exterior surface of the drum.

6. The attachment of claim 5 wherein said paddles are of equal lengths and are joinable to each other at their ends to form continuous portions of said helix.

7. The attachment of claim 1 wherein said first and second asphalt supply means comprise a main pipe for extension into the interior of the drum through the downstream end thereof to supply asphalt to material upstream of the downstream end of the drum, an auxiliary pipe branching from the main pipe to supply asphalt to material having exited the downstream end of the drum, and a valve disposed at the branch point of the main and auxiliary pipes for directing flow to one pipe or the other.

8. In combination with a direct-fired asphaltic concrete mixer having a cylindrical drum with upstream and downstream ends, means supporting the drum for rotation about its axis, a burner disposed at one end of the drum for supplying heat along the interior of the drum towards the other end of the drum, means for introducing material into the drum adjacent its upstream end, and means within the drum for moving material introduced therein as aforesaid through the drum in the downstream direction, a post-mixer comprising: a stationary enclosure spacedly enveloping the downstream portion of the drum, the enclosure having a lower curved wall concentric with the drum and spaced from the exterior thereof, said wall being effective to define a tunnel arcuate in cross-section and disposed beneath the lower half of the drum, the tunnel having an upstream end disposed adjacent the downstream end of the drum effective to receive material from the drum and a downstream end disposed intermediate said ends of the drum; means sealing the downstream end of the tunnel relative to the exterior of the drum; means for heating said wall; a first outlet disposed adjacent the downstream end of the drum for discharge of material from the drum; means for selectively closing the first outlet; means attached to the drum for moving material exiting the drum through the tunnel from its upstream to its downstream end when the first outlet is closed, the moving means also being effective to mix material in the tunnel as it moves therethrough; a second outlet disposed adjacent the downstream end of the tunnel for discharge of material therefrom; first means for supplying liquid asphalt to the interior of the drum upstream of its downstream end; and second means for alternately supplying liquid asphalt to material adjacent the upstream end of the tunnel, the second supply means being operative when the first outlet is closed and the first supply means being operative when the first outlet is open.

9. The combination of claim 8 wherein the burner is disposed at the upstream end of the drum; and wherein the enclosure includes a discharge box for air and burner gases, the box being disposed downstream of the upstream end of the tunnel and communicating with the interior of the drum, the discharge box having an outlet therefrom for exit of air and gases therefrom.

10. The combination of claim 9 wherein the enclosure includes closable means for access to the exterior of said portion of the drum when enveloped as aforesaid by the enclosure.

11. The combination of claim 8 wherein said moving means include a plurality of blades attached to the downstream end of the drum and disposed in skewed relation to the axis of the drum effective with respect to the direction of drum rotation to move material into said tunnel.

12. The combination of claim 11 wherein said moving means further include a plurality of paddles attached to the exterior surface of the drum, the paddles being spaced apart end-to-end effective to define portions of several helixes about said exterior surface of the drum effective with respect to the direction of drum rotation to mix and move material through said tunnel.

13. The combination of claim 12 wherein said paddles have outer longitudinal edges disposed closely adjacent the interior surface of said wall and opposite inner longitudinal edges spaced from the exterior surface of the drum.

14. The combination of claim 13 wherein said paddles are equal lengths and are joinable to each other at their ends to form continuous portions of said helixes.

15. The combination of claim 8 wherein said first and second asphalt supply means comprise a main pipe extending into the interior of the drum through the downstream end thereof to supply asphalt to material upstream of the downstream end of the drum, an auxiliary pipe branching from the main pipe to supply asphalt to material having exited the downstream end of the drum, and a valve disposed at the branch point of the main and auxiliary pipes for directing flow to one pipe or the other.

* * * * *